US009284958B2

(12) United States Patent
Inada et al.

(10) Patent No.: US 9,284,958 B2
(45) Date of Patent: Mar. 15, 2016

(54) ROTARY COMPRESSOR

(71) Applicant: DAIKIN INDUSTRIES, LTD., Osaka-shi, Osaka (JP)

(72) Inventors: Yukihiro Inada, Sakai (JP); Takazou Sotojima, Sakai (JP); Yoshitaka Shibamoto, Sakai (JP); Kenichi Sata, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/422,686

(22) PCT Filed: Aug. 19, 2013

(86) PCT No.: PCT/JP2013/004899

§ 371 (c)(1),
(2) Date: Feb. 19, 2015

(87) PCT Pub. No.: WO2014/030335

PCT Pub. Date: Feb. 27, 2014

(65) Prior Publication Data

US 2015/0240815 A1 Aug. 27, 2015

(30) Foreign Application Priority Data

Aug. 20, 2012 (JP) ..... 2012-181647

(51) Int. Cl.
*F01C 21/04* (2006.01)
*F01C 21/06* (2006.01)
(Continued)

(52) U.S. Cl.
CPC ..... *F04C 29/02* (2013.01); *F04C 18/063* (2013.01); *F04C 18/32* (2013.01); *F04C 18/322* (2013.01); *F04C 29/028* (2013.01); *F04C 18/045* (2013.01); *F04C 2240/56* (2013.01)

(58) Field of Classification Search
CPC ..... F04C 18/063; F04C 18/32; F04C 18/322; F04C 29/02; F04C 29/028; F04C 18/045; F04C 2240/56
USPC ..... 418/11, 67, 94, 102
See application file for complete search history.

(56) References Cited

U.S. PATENT DOCUMENTS 8,894,388 B2 * 11/2014 Lee ..... F04C 18/32 418/64
2008/0232992 A1 * 9/2008 Okamoto ..... F04C 29/023 418/91

(Continued)

FOREIGN PATENT DOCUMENTS

JP 8-42474 A 2/1996
JP 2013139722 A * 7/2013

OTHER PUBLICATIONS

International Search Report of corresponding PCT Application No. PCT/JP2013/004899 dated Oct. 22, 2013.

(Continued)

*Primary Examiner* — Thai Ba Trieu
*Assistant Examiner* — Dapinder Singh
(74) *Attorney, Agent, or Firm* — Global IP Counselors

(57) ABSTRACT

A rotary compressor includes a cylinder with a cylinder chamber, a piston, a blade and a pair of bushes. The piston is movable-within the cylinder chamber. The blade is integrally formed with the cylinder or piston and penetrates a groove formed in the other to segment the cylinder chamber into high and low pressure chambers. The bushes are provided at the groove and sandwich the blade from both sides of the blade. At least one of the pair of bushes includes an oil supply passage formed from a blade-side sliding surface to a groove-side sliding surface, a blade-side oil reservoir formed on the blade-side sliding surface, and a groove-side oil reservoir on the groove-side sliding surface. Ends of the oil supply passage open to the blade-side and groove-side oil reservoirs. The groove-side oil reservoir being wider than the blade-side oil reservoir.

9 Claims, 12 Drawing Sheets

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 27/02*** | (2006.01) |
| ***F04C 29/02*** | (2006.01) |
| ***F04C 29/04*** | (2006.01) |
| ***F04C 18/32*** | (2006.01) |
| ***F04C 18/063*** | (2006.01) |
| *F04C 18/04* | (2006.01) |

(56) References Cited

U.S. PATENT DOCUMENTS

2010/0326128 A1* 12/2010 Sotojima ..... F04C 18/02 418/58
2011/0243779 A1* 10/2011 Masuda ..... F04C 18/322 418/67

OTHER PUBLICATIONS

International Preliminary Report of corresponding PCT Application No. PCT/JP2013/004899 dated Mar. 5, 2015.

* cited by examiner

ROTARY COMPRESSOR

CROSS-REFERENCE TO RELATED APPLICATIONS

This U.S. National stage application claims priority under 35 U.S.C. §119(a) to Japanese Patent Application Nos. 2012-181647, filed in Japan on Aug. 20, 2012, the entire contents of which are hereby incorporated herein by reference.

TECHNICAL FIELD

The present invention relates to a rotary compressor, and more particularly to a measure to reduce abnormal wear and seizure of a rotary compressor.

BACKGROUND ART

Rotary compressors, each of which includes a hush supporting a piston eccentrically rotating within the cylinder chamber of a cylinder, have been conventionally known. Some of the rotary compressors include, as described in Japanese Unexamined Patent Publication No. H8-42474, a bush provided with an oil supply passage and an oil reservoir.

The rotary compressor of Japanese Unexamined Patent Publication No. H8-12474 is a rolling piston compressor. In this rotary compressor, a cylinder has a circular groove in which a bush is fitted in, and a blade supported by the bush to be movable back and forth and integrally formed with a piston. This blade segments a cylinder chamber of the cylinder into a high-pressure chamber and a low-pressure chamber.

The bush includes a pair of substantially semicylindrical members. One of the members is located at the high-pressure chamber of the cylinder chamber. The other member is located at the low-pressure chamber of the cylinder chamber. A flat side surface of each bush member slides back and forth along the outer surface of the blade. A curved side surface of each bush member slides to swing along the inner surface of the circular groove of the cylinder.

The above-described oil supply passage of the bush laterally penetrates the bush. The above-described oil reservoir of the bush is formed at each of the flat side surface and the curved side surface. One end of the oil supply passage of the bush open to the oil reservoir at the flat side surface (i.e., the blade-side oil reservoir). The other end is open to the oil reservoir at the curved side surface (i.e., the groove-side oil reservoir). Lubricant is supplied from an oil passage inside the blade to the oil reservoir at the flat side surface of the bush. The lubricant is supplied to the sliding surface of the bush along the blade. The lubricant, which has been supplied to the oil reservoir at the flat side surface of the bush, is supplied through the oil supply passage of the bush to the oil reservoir at the curved side surface of the bush.

SUMMARY

Technical Problem

However, in the operation of the rotary compressor, oil pressure in the blade-side oil reservoir of the bush acts on the inner surface of the blade-side oil reservoir. This oil pressure load pushes the bush onto the circular groove of the cylinder, thereby extremely narrowing the gap between the bush and the circular groove. Thus, even when the bush includes the groove-side oil reservoir, the oil is not properly supplied to the sliding surface of the bush along the circular groove.

The present invention was made in view of the problems. It is an objective of the present invention to reduce abnormal wear and seizure of a bush in a rotary compressor.

Solution to the Problem

A first aspect of the invention provides a rotary compressor including a cylinder (31*a*, 31*b*) including a cylinder chamber (51, 52); a piston (40*a*, 40*b*) configured to eccentrically rotate within the cylinder chamber (51, 52); a blade (35) integrally formed with one of the cylinder (31*a*, 31*b*) and the piston (40*a*, 40*b*) and penetrating a groove (48) formed in the other of the cylinder (31*a*, 31*b*) and the piston (40*a*, 40*b*) to segment the cylinder chamber (51, 52) into a high pressure chamber (51*b*, 52*b*) and a low pressure chamber (51*a*, 52*a*); and a pair of bushes (45*a* and 45*b*) provided at the groove (48) and sandwiching the blade (35) from both sides of the blade (35) support the blade (35). At least one of the pair of bushes (45*a* and 45*b*) includes an oil supply passage (1) formed from a blade-side sliding surface (7) to a groove-side sliding surface (6), a blade-side oil reservoir (2) formed on the blade-side sliding surface (7), one end of the oil supply passage (1) opening to the blade-side oil reservoir (2), and a groove-side oil reservoir (3) on the groove-side sliding surface (6), the other end of the oil supply passage (1) opening to the groove-side oil reservoir (3), the groove-side oil reservoir (3) being wider than the blade-side oil reservoir (2).

In the first aspect of the invention, in the operation of the rotary compressor, the oil pressure in the blade-side oil reservoir (2) of the bush (45*a*, 45*b*) acts on the inner surface (2*a*) of the blade-side oil reservoir (2). The oil pressure in the groove-side oil reservoir (3) acts on the inner surface (3*a*) of the groove-side oil reservoir (3). The oil pressure in the groove-side oil reservoir (3) is substantially equal to the oil pressure in the blade-side oil reservoir (2). On the other hand, the groove-side oil reservoir (3) is wider than the blade-side oil reservoir (2). Thus, a greater oil pressure load acts on the inner surface 13*a*) of the groove-side oil reservoir (3) than on the inner surface (2*a*) of the blade-side oil reservoir (2). Accordingly, the bush (45*a*, 45*b*) is pushed toward the blade (35) to expand the gap between the bush (45*a*, 45*b*) and the groove (48). The lubricant in the groove-side oil reservoir (3) of the bush (45*a*, 45*b*) flows into the expanded gap.

According to a second aspect of the invention, in the first aspect of the invention, the groove-side oil reservoir (3) of the hush (45*a*, 45*b*) extends to intersect a sliding direction of the bush (45*a*, 45*b*) along the groove (48).

In the second aspect of the invention, the bush (45*a*, 45*b*) moves in accordance with the eccentric motion of the piston (40). In accordance with the movement of the bush (45*a*, 45*b*), the groove-side oil reservoir (3) of the bush (45*a*, 45*b*) also moves. Here, the extending direction of the groove-side oil reservoir (3) intersects the loving direction of the bush (45*a*, 45*b*). Thus, as compared to the case where these directions coincide, the lubricant in the groove-side oil reservoir (3) widely spreads on the sliding surface of the bush (45*a*, 45*b*) along the groove (48).

According to a third aspect of the invention, in the second aspect of the invention, one end of the groove-side oil reservoir (3) of the bush (45*a*, 45*b*) communicates with an outside of the groove (48).

In the third aspect of the invention, lubricant, which has been supplied through the oil supply passage (1) of the bush (45*a*, 45*b*) to the groove-side oil reservoir (3) of the bush (45*a*, 45*b*), is discharged outside the groove (48) without staying in the groove-side oil reservoir (3).

According to a fourth aspect of the invention, in the first aspect of the invention, the groove-side oil reservoir (3) of the bush (45*a*, 45*b*) extends in a sliding direction of the bush (45*a*, 45*b*) along the groove (48). One end of the groove-side oil reservoir (3) of the bush (45*a*, 45*b*) communicates with an outside of the groove (48).

In the fourth aspect of the invention, the extending direction of the groove-side oil reservoir (3) of the bush (45*a*, 45*b*) coincides with the moving direction of the bush (45*a*, 45*b*). Thus, as compared to the case where the directions intersect one another, the lubricant in the groove-side oil reservoir (3) is smoothly discharged outside the groove (48).

According to a fifth aspect of the invention, in the fourth aspect of the invention, one end of the groove-side oil reservoir (3) of the bush (45*a*, 45*b*) communicates with the low pressure chamber (51*a*, 52*a*) of the cylinder chamber (51, 52) of the cylinder (31*a*, 31*b*).

In the fifth aspect of the invention, the one end of the groove-side oil reservoir (3) communicates with the low-pressure chamber (51*a*, 52*a*) of the cylinder chamber (51, 52). The low-pressure chamber (51*a*, 52*a*) of the cylinder (31*a*, 31*b*) has the lowest pressure inside the rotary compressor. Thus, the lubricant in the groove-side oil reservoir (3) of the bush (45*a*, 45*b*) flows to be sucked into the low-pressure chamber (51*a*, 52*a*) of the cylinder (31*a*, 31*b*).

According to a sixth aspect of the invention, the rotary compressor of any one of the first to fifth aspects of the invention further includes an oil storage (26) configured to store lubricant; and an oil passage (4) formed inside the blade (35) and allowing the lubricant in the oil storage (26) to circulate in the oil passage (4). An outlet (5) of the oil passage (4) of the blade (35) is open to a sliding surface of the blade (35) to face the blade-side oil reservoir (2) of the bush (45*a*, 45*b*). The blade-side oil reservoir (2) of the bush (45*a*, 45*b*) extends in the sliding direction of the bush (45*a*, 45*b*) along the blade (35).

In the sixth aspect of the invention, the outlet (5) of the oil passage (4) of the blade (35) reciprocates back and forth in accordance with the back and forth movement of the blade (35). Through this reciprocating outlet (5), the lubricant is supplied to the blade-side oil reservoir (2) of the bush (45*a*, 45*b*). Here, the blade-side oil reservoir (2) extends in the back and forth direction of the blade (35). Thus, as compared to the case where the blade-side oil reservoir (2) does not extend, the outlet (5) of the oil passage (4) of the blade (35) communicates with the blade-side oil reservoir (2) for a long period.

According to a seventh aspect of the invention, in any one of the first to sixth aspects of the invention, the groove-side oil reservoir (3) of the bush (45*a*, 45*b*) is formed by cutting and flattening the groove-side sliding surface (6) of the bush (45*a*, 45*b*).

In the seventh aspect of the invention, the groove-side oil reservoir (3) of the bush (45*a*, 45*b*) is formed between the flat cut-out surface of the curved side surface (6) of the bush (45*a*, 45*b*), and the inner surface of the groove (48).

According to an eighth aspect of the invention, in any one of the first to seventh aspects of the invention, each of the bushes (45*a* and 45*b*) is in a substantially semicylindrical shape. The groove-side oil reservoir (3) of the bush (45*a*, 45*b*) includes a plurality of vertical grooves (9*a*) formed on both sides of an apex (8) of a curved side surface (6) of the bush (45*a*, 45*b*) and extending along a height of the bush (45*a*, 45*b*), and a lateral groove (9*b*) crossing the apex (8) of the curved side surface (6) of the bush (45*a*, 45*b*) to communicate with the plurality of vertical grooves (9*a*).

In the eighth aspect of the invention, the lubricant, which has flown through the oil supply passage (1) of the bush (45*a*, 45*b*) to the lateral groove (9*b*) of the bush (45*a*, 45*b*), is supplied through the lateral groove (9*b*) to the plurality of vertical grooves (9*a*).

According to a ninth aspect of the invention, in any one of the first to eighth aspects of the invention, only a low-pressure side bush (45*a*) of the pair of bushes (45*a* and 45*b*) located at a low pressure chamber (51*a*, 52*a*) side includes the oil supply passage (1), the blade-side oil reservoir (2), and the groove-side oil reservoir (3).

In the ninth aspect of the invention, in the operation of the rotary compressor, the pressing force caused by the difference in the pressure between the high pressure chamber (51*b*, 52*b*) and the low pressure chamber (51*a*, 52*a*) of the cylinder chamber (51, 52) acts on the low-pressure side bush (45*a*). The low-pressure side bush (45*a*) includes the blade-side oil reservoir (2), the groove-side oil reservoir (3), and the oil supply passage (1). Thus, the oil pressure load of the groove-side oil reservoir (3) acts against the pressing force acting on the low-pressure side bush (45*a*) caused by the difference in the pressure between the high pressure chamber (51*b*, 52*b*) and the low pressure chamber (51*a*, 52*a*).

Advantages of the Invention

According to the present invention, the groove-side oil reservoir (3) is wider than the blade-side oil reservoir (2). Thus, the oil pressure load acting on the inner surface (3*a*) of the groove-side oil reservoir (3) is greater than the oil pressure load acting on the inner surface (2*a*) of the blade-side oil reservoir (2). The difference between these oil pressure loads pushes the bush (45*a*, 45*b*) toward the blade (35), thereby expanding the gap between the bush (45*a*, 45*b*) and the groove (48). Accordingly, oil is reliably supplied to the sliding surface of the bush (45*a*, 45*b*) along the groove (48), thereby reducing abnormal wear and seizure of the bush (45*a*, 45*b*).

In the second aspect of the invention, the extending direction of the groove-side oil reservoir (3) of the bush (45*a*, 45*b*) intersects the moving direction of the bush (45*a*, 45*b*). Thus, as compared to the case where these directions do not intersect, the lubricant in the groove-side oil reservoir (3) is more likely to spread on the sliding surface of the bush (45*a*, 45*b*) along the groove (48). Accordingly, the oil is further reliably supplied to the sliding surface of the bush (45*a*, 45*b*) along the groove (48).

In the third aspect of the invention, one end of the groove-side oil reservoir (3) of the bush (45*a*, 45*b*) communicates with the outside of the groove (48). Thus, the lubricant in the groove-side oil reservoir (3) is discharged outside the groove (48). Accordingly, the lubricant circulates in the groove-side oil reservoir (3), thereby reducing a rise in the temperature of the lubricant in the groove-side oil reservoir (3). As a result, cooling of the sliding surface of the bush (45*a*, 45*b*) along the groove (48) progresses.

In the fourth aspect of the invention, the extending direction of the groove-side oil reservoir (3) of the bush (45*a*, 45*b*) coincides with the moving direction of the bush (45*a*, 45*b*). Thus, the lubricant in the groove-side oil reservoir (3) is smoothly discharged outside the groove (48). The cooling of the sliding surface of the bush (45*a*, 45*b*) along the groove (48) further progresses.

In the fifth aspect of the invention, the one end of the groove-side oil reservoir (3) of the bush (45*a*, 45*b*) communicates with the low pressure chamber (51*a*, 52*a*) of the cylinder chamber (51, 52) of the cylinder (31*a*, 31*b*), which has the lowest pressure inside the rotary compressor. Thus, the lubricant in the groove-side oil reservoir (3) of the bush (45*a*, 45*b*) further smoothly flows toward the low-pressure chamber (51*a*, 52*a*). Accordingly, the cooling of the sliding surface of the bush (45*a*, 45*b*) along the groove (48) further progresses.

In the sixth aspect of the invention, the blade-side oil reservoir (2) of the bush (45*a*, 45*b*) extends in the back and forth direction of the blade (35). Thus, as compared to the case where the blade-side oil reservoir (2) does not extend, the outlet (5) of the oil passage (4) of the blade (35) communicates with the blade-side oil reservoir (2) for a long period. This increases the amount of the lubricant supplied through the outlet (5) of the oil passage (4) to the blade-side oil reservoir (2).

In the seventh aspect of the invention, the curved side surface (6) of the bush (45*a*, 45*b*) is cut and flattened to form the groove-side oil reservoir (3) of the bush (45*a*, 45*b*). Thus, as compared to the case where, for example, a groove is provided in the curved side surface (6) to form the groove-side oil reservoir (3) of the bush (45*a*, 45*b*), the groove-side oil reservoir (3) of the bush (45*a*, 45*b*) is readily formed.

In the eighth aspect of the invention, the groove-side oil reservoir (3) of the bush (45*a*, 45*b*) includes the lateral groove (9*b*) and the plurality of vertical grooves (9*a*). Thus, as compared to the case where the groove-side oil reservoir (3) of the bush (45*a*, 45*b*) does not include a plurality of grooves, the inner surface (3*a*) of the groove-side oil reservoir (3) of the bush (45*a*, 45*b*) is wide. This increases the oil pressure load acting on the inner surface (3*a*) of the groove-side oil reservoir (3).

In particular, in the case of the rotary compressor having the groove (48) in the piston (40) and the blade (35) in the cylinder (31*a*, 31*b*), great stress is applied on the apex (8) of the curved side surface (6) of the bush (45*a*, 45*b*) due to the pressure in the compression chamber formed on the both sides of the piston (40) in the operation of the rotary compressor. In the eighth aspect of the invention, the lateral groove (9*b*) crosses this apex (8) of the curved side surface (6). Thus, as compared to the case where the vertical grooves (9*a*) is formed in the apex (8) of the curved side surface (6), the surface of the apex (8) of the curved side surface (6) without grooves readily expands. Accordingly, even when great stress is applied on the apex (8) of the curved side surface (6), this stress is received by the surface of the apex (8) of the curved side surface (6) without grooves. As a result, the bush (45*a*, 45*b*) is less likely to be damaged.

In the ninth aspect of the invention, the low-pressure side bush (45*a*) includes the oil supply passage (1), the blade-side oil reservoir (2), and the groove-side oil reservoir (3). Thus, the oil pressure load of the groove-side oil reservoir (3) acts on the low-pressure side bush (45*a*) against the pressing force of the blade (35) caused by the difference in the pressure between the high pressure chamber (51*b*, 52*b*) and the low pressure chamber (51*a*, 52*a*) of the cylinder chamber (51, 52). Accordingly, as compared to the case where the low-pressure side bush (45*a*) does not include the oil reservoir (2, 3) or the oil supply passage (1), the gap between the low-pressure side bush (45*a*) and the groove (48) of the piston (40*a*, 40*b*) is less likely to narrow. In addition, since the high-pressure side bush (45*b*) does not include the oil reservoir (2, 3) or the oil supply passage (1), the structure of the bush (45*a*, 45*b*) is simplified.

BRIEF DESCRIPTION OF THE DRAWINGS

FIG. 3A is a view of the swing bush seen from a flat side surface. FIG. 3B is a view of the swing bush seen from a curved side surface.

FIG. 4A is a lateral cross-sectional view of the compression mechanism near the swing bush. FIG. 4B is a schematic view illustrating the force acting on the swing bush.

DESCRIPTION OF EMBODIMENTS

An embodiment of the present invention will be described hereinafter in detail with reference to the drawings.

Figure 1:
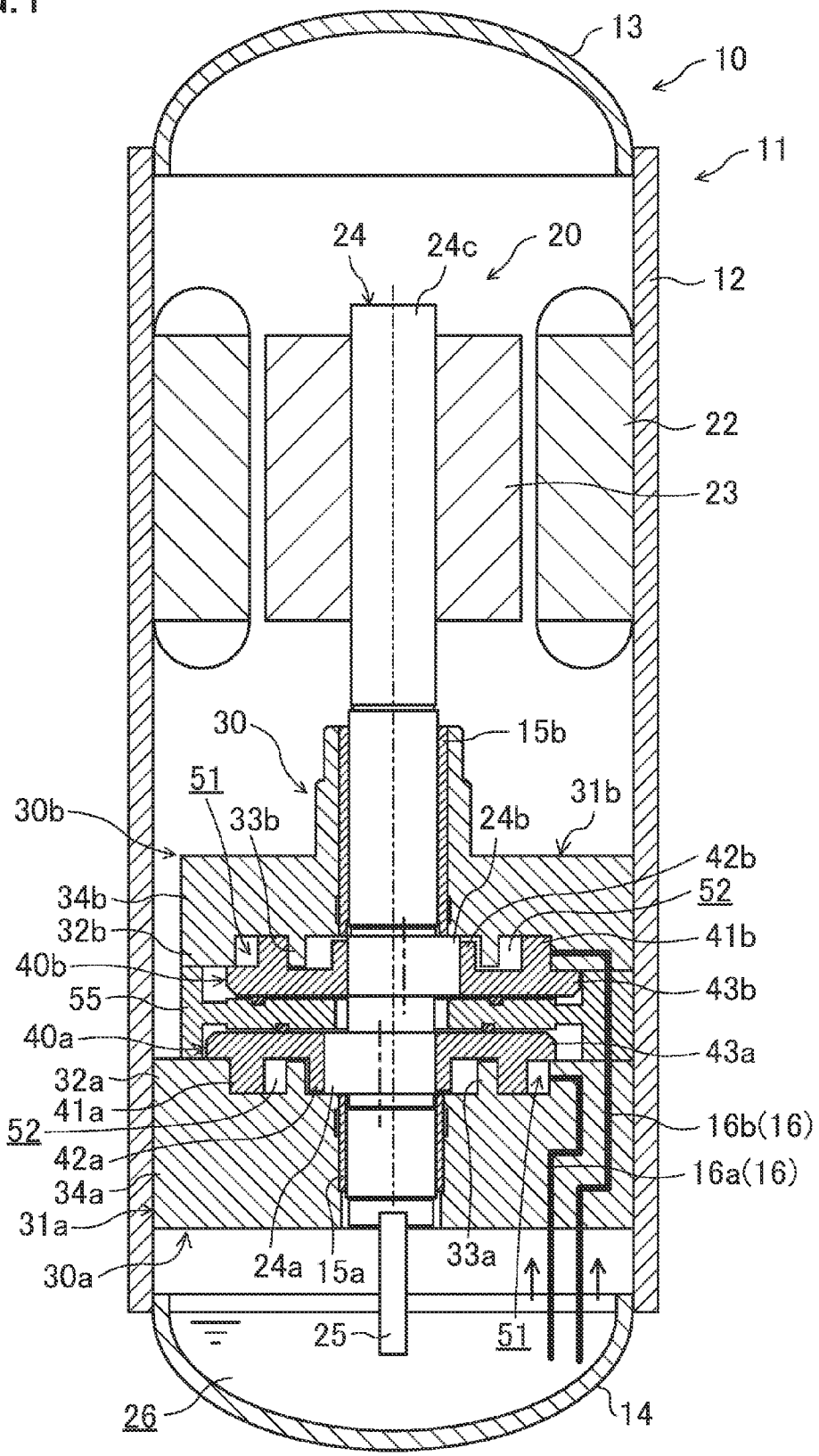
FIG. 1 is a vertical cross-sectional view of a two-stage compressor according to an embodiment of the present invention.

A two-stage compressor (10) according to the embodiment of the present invention is connected to, for example, a refrigerant circuit of an air conditioner. As shown in FIG. 1, this two-stage compressor (10) includes a casing (11), which houses a motor (20) and a compression mechanism (30) connected together by a single drive shaft (24). The compression mechanism (30) is located under the motor (20).

The casing (11) includes a vertically extending cylindrical body (12), a bowl-shaped upper end plate (13) closing an upper opening of the body (12), and a bowl-shaped lower end plate (14) closing a lower opening of the body (12). This casing (11) is a closed container formed by fixing the upper end plate (13) on the body (12) by welding, and fixing the lower end plate (14) under the body (12) by welding. An oil storage (26) is formed on the bottom of the casing (11). This oil storage (26) stores lubricant lubricating the compression mechanism (30).

The motor (20) includes a stator (22) and a rotor (23). The stator (22) is fixed to the body (12) of the casing (11). The rotor (23) is located inside the stator (22). The drive shaft (24) is fixed to the rotor (23). The rotor (23) and the drive shaft (24) rotate integrally.

The drive shaft (24) includes a vertically extending main shaft (24*c*), and low-stage and high-stage eccentric parts (24*a* and 24*b*) formed near the lower end of this main shaft (24*c*).

The low-stage eccentric part (24*a*) is located under the high-stage eccentric part (24*b*). Each eccentric part (24*a*, 24*b*) is in a columnar shape having a larger diameter than the main shaft (24*c*). The axis of each eccentric part (24*a*, 24*b*) is eccentric to the axis of the main shaft (24*c*). The eccentric directions of the eccentric parts (24*a* and 24*b*) are shifted from one another by 180°.

An oil supply pump (25) is provided at a lower end of the drive shaft (24). A discharge port of the oil supply pump (25) communicates with a shaft hole (not shown) formed inside the drive shaft (24). The oil supply pump (25) is of a differential pressure type, which utilizes the internal pressure (the pressure of a high-pressure refrigerant) of the internal space of the casing (11) to transport the lubricant stored in the oil storage (26) of the casing (11) to the shaft hole. The lubricant transported from the oil supply pump (25) to the shaft hole is utilized to lubricate sliding parts, etc., of the compression mechanism (30).

In the compression mechanism (30), a low-stage cylinder (31*a*), a low-stage piston (40*a*), a middle plate (55), a high-stage piston (40*b*), and a high-stage cylinder (31*b*) are stacked in a bottom-to-top order. These members 31*a*, 40*a*, 55, 40*b*, and 31*b*) are fastened by a plurality of vertically extending bolts (not shown). The drive shaft (24) penetrates the center of the compression mechanism (30). The low-stage cylinder (31*a*), the low-stage piston (40*a*), and the middle plate (55) form a low-stage compression part (30*a*). The high-stage cylinder (31*b*), the high-stage piston (40*b*), and the middle plate (55) form a high-stage compression part (30*b*).

Each cylinder (31*a*, 31*b*) includes a cylinder end plate (34*a*, 34*b*), an outer ring-shaped cylinder part (32*a*, 32*b*), and an inner ring-shaped cylinder part (33*a*, 33*b*). A central portion of the high-stage cylinder end plate (34*b*) protrudes upward. A through hole, into which the drive shaft (24) is inserted, is formed in a central portion of each cylinder end plate (34*a*, 34*b*). A sliding bearing (15*a*, 15*b*) supporting the drive shaft (24) is provided on the inner circumferential surface of each through hole.

The outer cylinder part (32*a*) and the inner cylinder part (33*a*) at the low stage protrude from the low-stage cylinder end plate (34*a*) toward the low-stage piston (40*a*). The outer cylinder part (32*b*) and the inner cylinder part (33*b*) at the high stage protrude from the high-stage cylinder end plate (34*b*) toward the high-stage piston (40*b*). In each cylinder (31*a*, 31*b*), a ring-shaped space (C) is formed between the outer cylinder part (32*a*, 32*b*) and the inner cylinder part (33*a*, 33*b*).

Each piston (40*a*, 40*b*) includes a disk-like piston end plate (43*a*, 43*b*), a ring-shaped piston part (41*a*, 41*b*) protruding from the end surface of the piston end plate (43*a*, 43*b*) at a position closer to the outer circumference, and a ring-shaped projection (42*a*, 42*b*) protruding from the end surface of the piston end plate (43*a*, 43*b*) at a position closer to the inner circumference. Each piston (40*a*, 40*b*) is housed in the space (C) to be eccentric to the cylinder (31*a*, 31*b*). The piston (40*a*, 40*b*) segments the space (C) into an outer fluid chamber (51) and an inner fluid chamber (52). The outer fluid chamber (51) and the inner fluid chamber (52) form the cylinder chamber.

The eccentric part (24*a*, 24*b*) of the drive shaft (24) is fitted in the ring-shaped projection (42*a*, 42*b*). The piston (40*a*, 40*b*) eccentrically rotates to the axis of the main shaft (24*a*) in accordance with the rotation of the drive shaft (24). In the compression mechanism (30), while a space is formed between the ring-shaped projection (42*a*, 42*b*) of the corresponding piston (40*a*, 40*b*) and the inner cylinder part (33*a*, 33*b*) of each cylinder (31*a*, 31*b*), the refrigerant is not compressed in this space.

Figure 2:
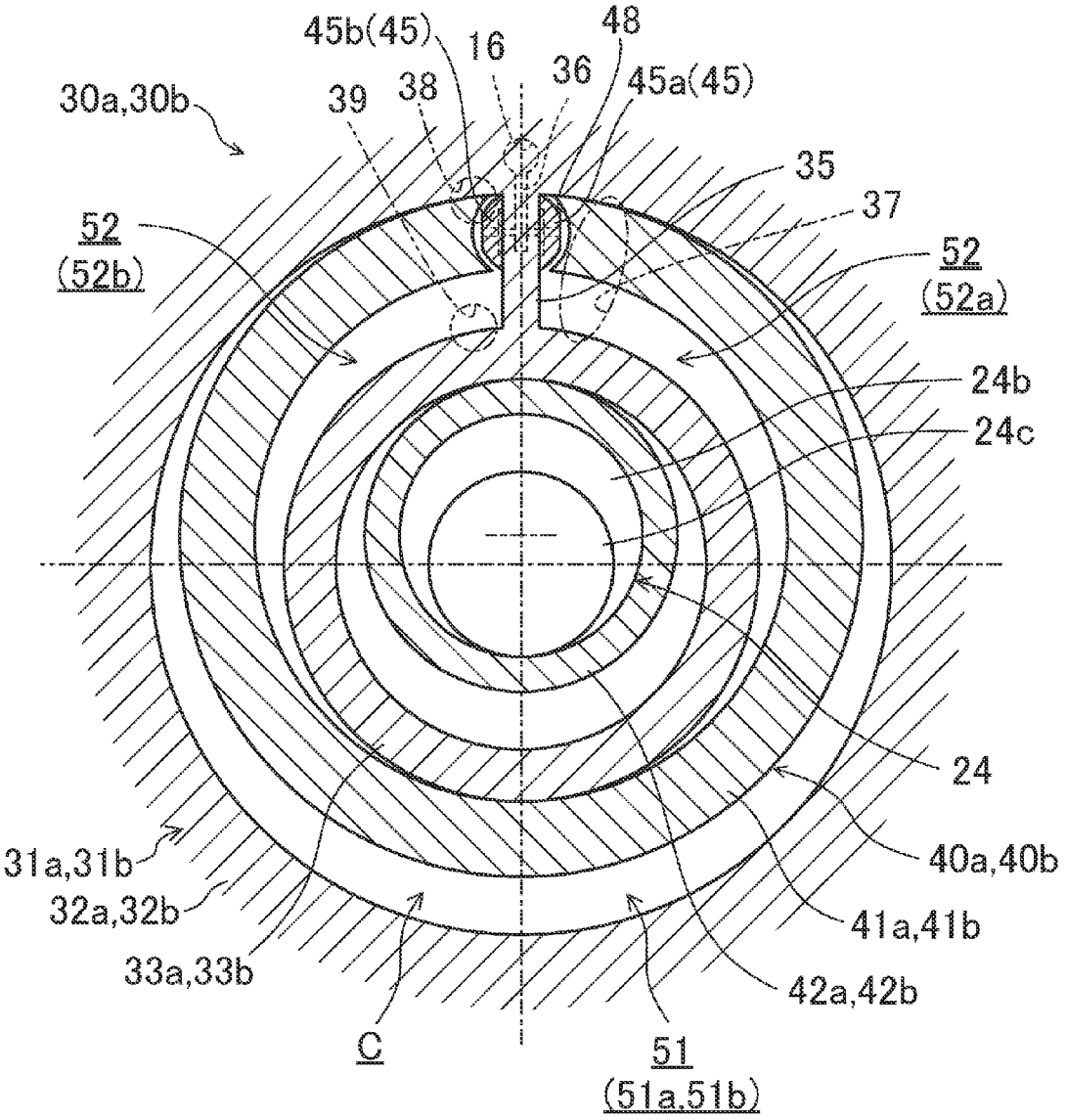
FIG. 2 is a lateral cross-sectional view of a compression mechanism of the two-stage compressor according to the embodiment of the present invention.

As shown in FIG. 2, the ring-shaped piston part (41*a*, 41*b*) of the piston (40*a*, 40*b*) is in a C-shape, part of which is cut. The cut portion of the ring-shaped piston part (41*a*, 41*b*) forms a groove (48). The inner surface of the groove (48) is a curved surface. A blade (35) radially connecting the outer cylinder part (32*a*) to the inner cylinder part (33*a*) is integrally formed with each cylinder (31*a*, 31*b*). This blade (35) penetrates the groove (48) of the piston (40*a*, 40*b*). This blade (35) segments each of the outer fluid chamber (51) and the inner fluid chamber (52) of the space (C) into a low pressure chamber (52*a*, 52*a*) and a high pressure chamber (51*b*, 52*b*).

Each of the low-stage and the high-stage cylinders (31*a* and 31*b*) is provided with a suction port (37). One end of the low-stage suction port (37) communicates with the low-pressure chamber (51*a*) of the outer fluid chamber (51) and the low-pressure chamber (52*a*) of the inner fluid chamber (52) at the low stage. The other end communicates with a suction pipe (not shown). This suction pipe penetrates the casing (11). One end of the high-stage 115 suction port (37) communicates with the low-pressure chamber (51*a*) of the outer fluid chamber (51) and the low-pressure chamber (52*a*) of the inner fluid chamber (52) at the high stage. The other end communicates with one end of an intermediate pipe (not shown) which penetrates the casing (11).

Each of the low-stage and high-stage cylinders (31*a* and 31*b*) is provided with an outer discharge port (38), and an inner discharge port (39). One end of the outer discharge port (38) at the low stage is open to the high-pressure chamber (52*b*) of the outer fluid chamber (Si) at the low stage. One end of the inner discharge port (39) at the low stage is open to the high-pressure chamber (52*b*) of the inner fluid chamber (52) at the low stage. The other ends of the outer discharge port (38) at the low stage and the inner discharge port (39) at the low stage join together to communicate to the other end of the intermediate pipe.

One end of the outer discharge port (38) at the high stage is open to the high-pressure chamber (51*b*) of the outer fluid chamber (51) at the high stage. One end of the inner discharge port (39) at the high stage is open to the high-pressure chamber (52*b*) of the inner fluid chamber (52) at the high stage. The other ends of the outer discharge port (38) at the high stage and the inner discharge port (39) at the high stage are open to the inside of the casing (11).

A pair of swing bushes (45*a* and 45*b*) are fitted in the groove (48) of each piston (40*a*, 40*b*) to sandwich the blade (35) of the corresponding cylinder (31*a*, 31*b*). The pair of swing bushes (45*a* and 45*b*) form a pair of bushes.

One of the pair of swing bushes (45*a*, 45*b*) is the low-pressure swing bush (45*a*) placed near the low-pressure chamber (51*a*, 52*a*) of the cylinder (31*a*, 31*b*). The other is the high-pressure swing bush (45*b*) placed near the high-pressure chamber (51*b*, 52*b*) of the cylinder (31*a*, 31*b*).

Figure 3A:
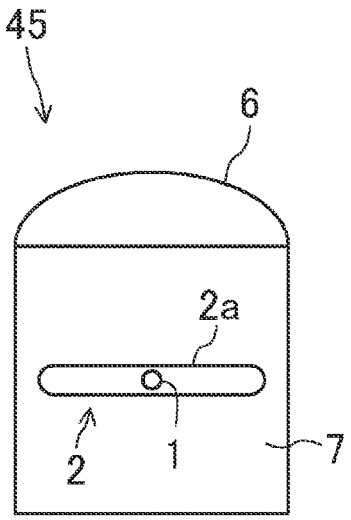
FIGS. 3A and 3B are perspective views illustrating a swing bush of the embodiment.
Figure 3B:
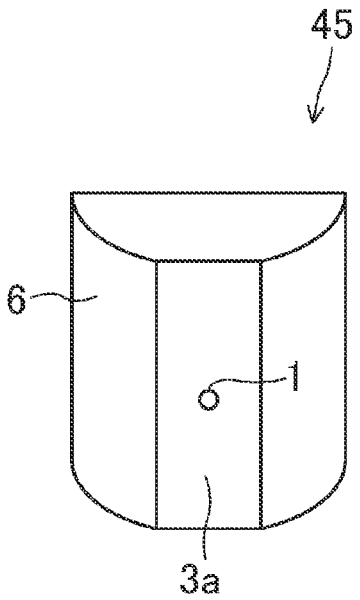

As shown in FIGS. 3A and 3B, each swing bush (45*a*, 45*b*) is in a substantially semicylindrical shape. A flat side surface (7) of the swing hush (45*a*, 45*b*) slides back and forth along the side surface of the blade (35) of each cylinder (31*a*, 31*b*). This sliding direction is along the length of the blade (35). A curved side surface (6) of the swing bush (45*a*, 45*b*) slides to swing along the inner surface of the groove (48) of each piston (40*a*, 40*b*). This sliding direction is along the circumference of the inner circumferential surface of the groove (48).

Each swing bush (45*a*, 45*b*) includes an oil supply passage (1), a blade-side oil reservoir (2), and a groove-side oil reservoir (3).

The blade-side oil reservoir (2) is formed on the flat side surface (7) of the swing bush (45*a*, 45*b*). The blade-side oil reservoir (2) is a groove extending in the sliding direction of the swing bush (45*a*, 45*b*) along the blade (35). That is, the blade-side oil reservoir (2) is a horizontal groove extending along the radius of the two-stage compressor (10). The both ends of the blade-side oil reservoir (2) are closed.

The groove-side oil reservoir (3) is formed on the curved side surface (6) of the swing bush (45*a*, 45*b*). The groove-side oil reservoir (3) extends to intersect the moving direction of the swing bush (45*a*, 45*b*). That is, the groove-side oil reservoir (3) is formed between the cut-out surface formed by cutting and flattening the apex of the curved side surface (6) of the swing bush (45*a*, 45*b*), and the inner surface of the groove (48) of the piston (40*a*, 40*b*). The both ends of the groove-side oil reservoir (3) are vertically open.

The groove-side oil reservoir (3) is wider than the blade-side oil reservoir (2). The projected area of the groove-side oil reservoir (3) when being projected on the surface parallel to the flat side surface (7) of the swing bush (45*a*, 45*b*) is wider than the projected area of the blade-side oil reservoir (2) when being projected on the surface parallel to the flat side surface (7) of the swing bush (45*a*, 45*b*). That is, the area of the cut-out surface of the swing bush (45*a*, 45*b*) facing the groove-side oil reservoir (3) is wider than the area of the bottom of the blade-side oil reservoir (2).

The oil supply passage (1) penetrates the center of the swing bush (45*a*, 45*b*). One end of the oil supply passage (1) is open to the center of the blade-side oil reservoir (2). The other end is open to the center of the groove-side oil reservoir (3). Through this oil supply passage (1), oil is supplied from the blade-side oil reservoir (2) to the groove-side oil reservoir (3).

Figure 4A:
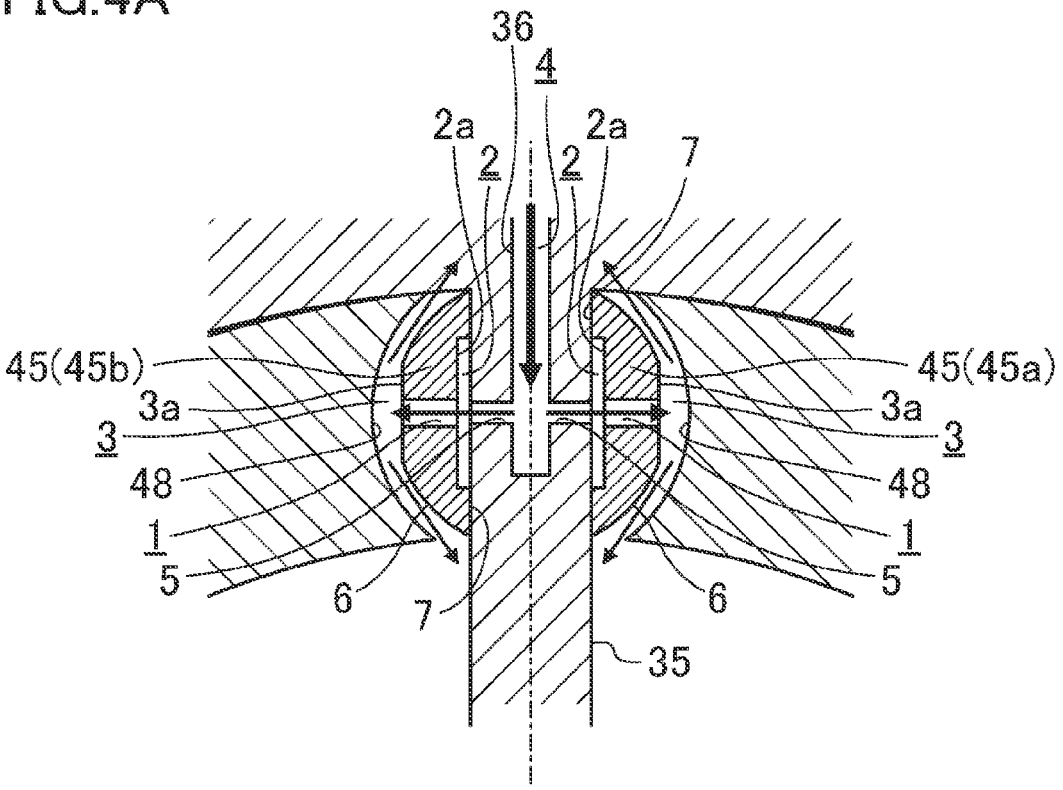
FIGS. 4A and 4B illustrate the swing bush of the embodiment.

As shown in FIG. 4A, an oil passage (36) is firmed in the blade (35). The oil passage (36) includes a first passage (4) extending along the length of the blade (35), and a second passage (5) open to the first passage (4) and the sliding surface of the swing bush (45*a*, 45*b*).

The first passage (4) of the oil passage (36) communicates with a supply passage (16) provided in the compression mechanism (30). This supply passage (16) is the passage for sucking the lubricant stored in the oil reservoir (26) up to the compression mechanism (30) and supplying the oil to the oil passage (36) of the blade (35). The supply passage (16) is formed in the compression mechanism (30) such that the lower end is immersed in the oil reservoir (26) and the upper end communicates with the end of the first passage (4) of the oil passage (36). In this embodiment, the supply passage (16) is provided as different passages (16*a* and 16*b*) in the low-stage and high-stage compression parts (30*a* and 30*b*).

Driving Operation

Next, the driving operation of the two-stage compressor (10) will be described. First, when the motor (20) starts, the rotation of the rotor (23) is transmitted to the low-stage and high-stage pistons (40*a* and 40*b*) via the drive shaft (24). Then, in the compression mechanism (30), the blade (35) reciprocates (moves back and forth) relative to the swing bushes (45*a* and 45*b*). Each piston (40*a*, 40*b*) swings together with the swing bushes (45*a* and 45*b*) in the cylinder 31*a*, 31*b*). Then, the piston (40*a*, 40*b*) revolves in the corresponding cylinder (31*a*, 31*b*) while swinging so that the compression mechanism (30) sequentially repeats an intake stroke, a compression stroke, and a discharge stroke.

Specifically, fluid is sucked from the suction pipe of the casing through the low-stage suction port (37) to the outer fluid chamber (51) at the low stage and the inner fluid chamber (52) at the low stage, and then compressed. The fluid, which has been compressed in the fluid chamber (51), and the fluid, which has been compressed in the fluid chamber (52), are discharged from the low-stage discharge ports (38 and 39) corresponding to the fluid chambers (51 and 52), respectively, and then, join together to flow into the intermediate pipe of the casing (11).

After that, the fluid is sucked from the intermediate pipe through the high-stage suction port (37) to the outer fluid chamber (51) and the inner fluid chamber (52) at the high stage, and then compressed. The fluid compressed in these fluid chambers (51 and 52) is discharged from the high-stage discharge ports (38 and 39) corresponding to the fluid chambers (51 and 52), respectively, inside the casing (11). The discharge, which has been discharged inside the casing (11), flows out of a discharge pipe (not shown) penetrating the casing (11).

Figure 5:
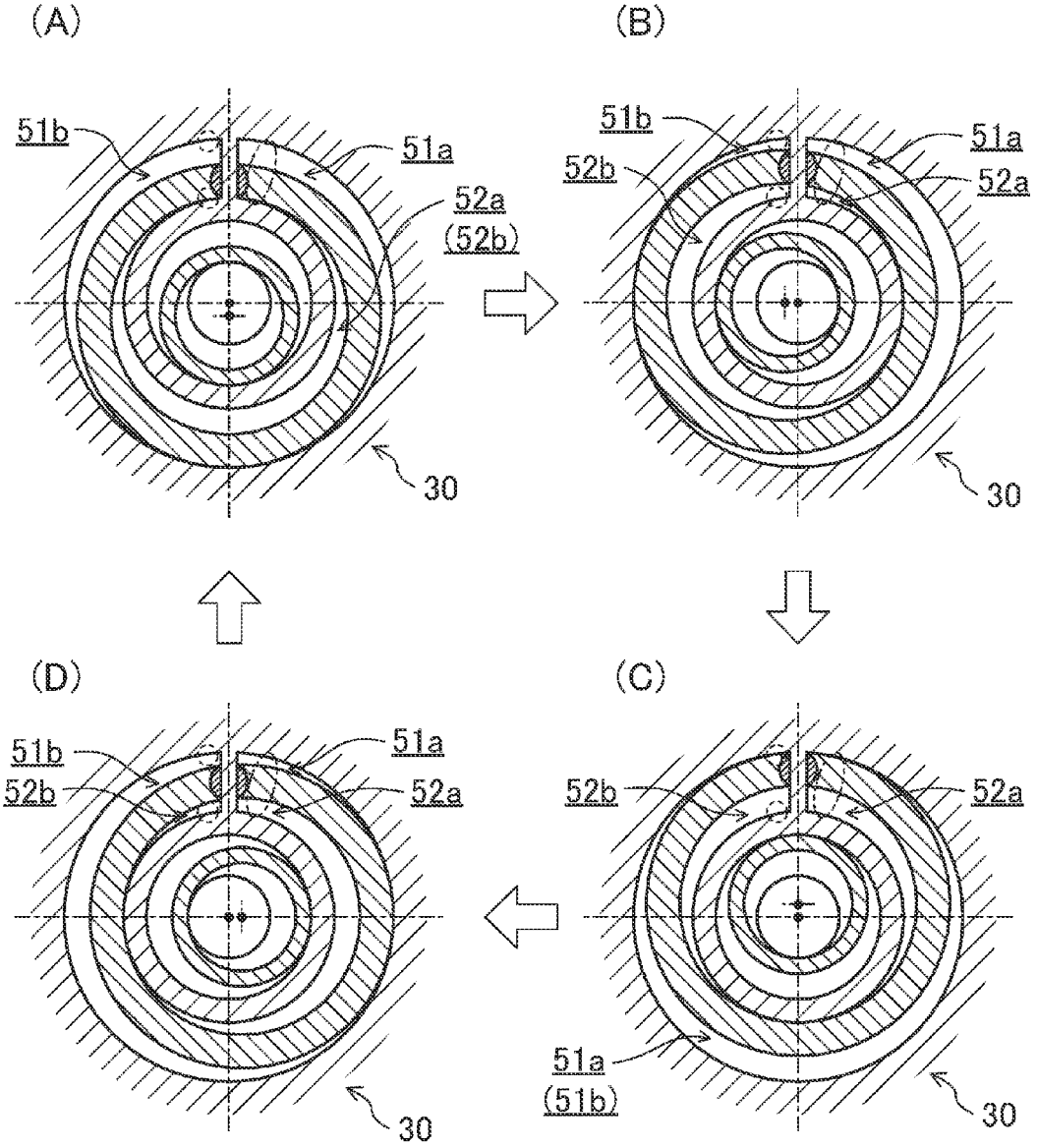
FIG. 5 illustrates the operation of the compression mechanism of the two-stage compressor of the embodiment.

The operations of the outer fluid chamber (51) and the inner fluid chamber (52) of each compression part (30*a*, 30*b*) will be specifically described. In the outer fluid chamber (51), the outer low-pressure chamber (51*a*) has an almost minimum volume in the state (D) of FIG. 5. From this state, the drive shaft (24) rotates clockwise in the figure to change the states (A)-(C) as shown in FIG. 5, thereby increasing the volume of the outer low-pressure chamber (51*a*). At this time, the refrigerant is sucked into the outer tow-pressure chamber (51*a*) through the suction port (37).

In the state (C) of FIG. 5, the suction of the refrigerant to the outer low-pressure chamber (51*a*) is complete. This outer low-pressure chamber (51*a*) becomes the outer high pressure chamber (51*b*) compressing the refrigerant, and a new outer low-pressure chamber (51*a*) is formed with the blade (35) interposed between the new outer low-pressure chamber (51*a*) and the outer high-pressure chamber (51*b*). When the drive shaft (24) further rotates, the refrigerant is repeatedly sucked in the outer low-pressure chamber (51*a*), while the volume of the outer high-pressure chamber (51*b*) decreases to compress the refrigerant in the outer high-pressure chamber (51*b*).

On the other hand, in the inner fluid chamber (52), the inner low-pressure chamber (52*a*) has an almost minimum volume in the state (B) of FIG. 5. From this state, the drive shaft (24) rotates clockwise in the figure to change the states (C)-(A) as shown in FIG. 5, thereby increasing the volume of the inner low pressure chamber (52*a*). At this time, the refrigerant is sucked into the inner low-pressure chamber (52*a*) through the suction port (37).

In the state (A) of FIG. 5, the suction of the refrigerant to the inner low-pressure chamber (52*a*) is complete. This inner low-pressure chamber (52*a*) becomes the inner high pressure chamber (52*b*) compressing the refrigerant, and a new inner low-pressure chamber (52*a*) is formed with the blade (35) interposed between the new inner low-pressure chamber (52*a*) and the inner high-pressure chamber (52*b*). When the drive shaft (24) further rotates, the refrigerant is repeatedly sucked in inner low-pressure chamber (52*a*), while the volume of the inner low-pressure chamber (52*a*) decreases to compress the refrigerant in the inner high-pressure chamber (52*b*).

In the outer fluid chamber for (51), under the operation conditions where the discharge of the refrigerant starts, for example, at almost the time (B) of FIG. 5, the discharge starts at almost the time (D) of FIG. 5 in the inner fluid chamber (52). That is, the discharge timing of the outer fluid chamber (51) is different from that of the inner fluid chamber (52) by about 180°. The refrigerant compressed in the outer fluid chamber (51) is discharged from the outer discharge port (38). The refrigerant compressed in the inner fluid chamber (52) is discharged from the inner discharge port (39). The two-stage compressor (10) is of a what is called high-pressure dome type, in which the internal space of the casing (11) is filled with a high-pressure refrigerant.

In the operation of the two-stage compressor (10), the lubricant in the oil storage (26) flows through the supply passage (16) to the first passage (4) of the oil passage (36) of each blade (35). The lubricant in the first passage (4) of the oil passage (36) flows through the second passage (5) of the oil passage (36) to the blade-side oil reservoir (2) of the swing bush (45) to lubricate the sliding surface of the swing bush (45) along the blade (35). The lubricant in the blade-side oil reservoir (2) flows through the oil supply passage (1) of the swing bush (45) to the groove-side oil reservoir (3) of the swing bush (45) to lubricate the sliding surface of the swing bush (45) along the groove (48) of the piston (40*a*, 40*b*).

Here, the oil pressure in the blade-side oil reservoir (2) of the swing bush (45*a*, 45*b*) acts on the bottom (2*a*) of the blade-side oil reservoir (2), while the oil pressure in the groove-side oil reservoir (3) acts on the cut-out surface (3*a*) of the swing bush (45*a*, 45*b*) facing the groove-side oil reservoir (3). As described above, the cut-out surface (3*a*) is larger than the inner surface (2*a*) of the blade-side oil reservoir (2).

Figure 4B:
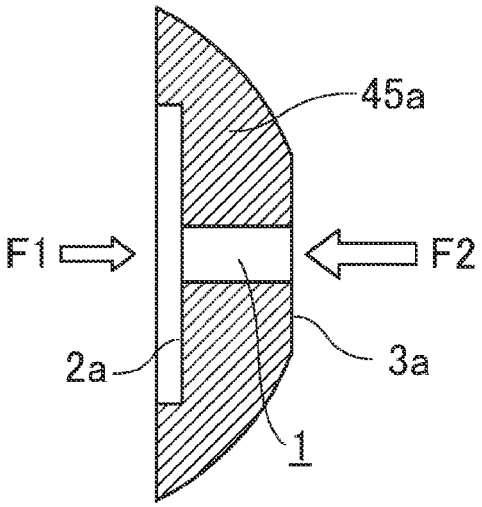

In this embodiment, the oil pressure in the blade-side oil reservoir (2) is substantially equal to the oil pressure in the groove-side oil reservoir (3). Thus, as shown in FIG. 4B, an oil pressure load (F2), which is greater than an oil pressure load (F1) acting on the inner surface (2*a*) of the blade-side oil reservoir (2), acts on the cut-out surface (3*a*) of the swing bush (45*a*, 45*b*) facing the groove-side oil reservoir (3). This pushes each swing bush (45*a*, 45*b*) toward the blade (35) to expand the gap between the swing bush (45*a*, 45*b*) and the groove (48). The lubricant in the groove-side oil reservoir (3) of the swing bush (45*a*, 45*b*) flows to the expanded gap.

The swing hush (45*a*, 45*b*) rotates at a predetermined angle in accordance with the eccentric motion of the piston (40*a*, 40*b*). The groove-side oil reservoir (3) of the swing bush (45*a*, 45*b*) moves in accordance with the rotation of the swing bush (45*a*, 45*b*). The extending direction of the groove-side oil reservoir (3) is orthogonal to the moving direction of the swing bush (45*a*, 45*b*). Thus, as compared to the case where the directions coincide, the lubricant the groove-side oil reservoir (3) spreads widely on the sliding surface of the swing bush (45*a*, 45*b*) along the groove (48).

Since the both ends of the groove-side oil reservoir (3) are vertically open, the lubricant supplied through the oil supply passage (1) of the swing bush (45*a*, 45*b*) to the groove-side oil reservoir (3) of the swing bush (45*a*, 45*b*) is discharged outside the groove (48) without staying in the groove-side oil reservoir (3).

An outlet (5) of the oil passage (4) of the blade (35) reciprocates back and forth in accordance with the back and forth movement of the blade (35). Through this reciprocating outlet (5), the lubricant is supplied to the blade-side oil reservoir (2) of the swing bush (45*a*, 45*b*). As described above, the blade-side oil reservoir (2) extends in the back and forth direction of the blade (35). Thus, as compared to the case where the blade-side oil reservoir (2) does not extend, the outlet (5) of the oil passage (4) of the blade (35) communicates with the blade-side oil reservoir (2) for a long period.

Advantages of Embodiment

In the embodiment, the cut-out surface (3*a*) of the swing bush (45*a*, 45*b*) facing the groove-side oil reservoir (3) is larger than the bottom (2*a*) of the blade-side oil reservoir (2). Thus, the oil pressure load acting on the cut-out surface (3*a*) of the swing bush (45*a*, 45*b*) is greater than the oil pressure load acting on the bottom (2*a*) of the blade-side oil reservoir (2) of the swing bush (45*a*, 45*b*).

The difference in the oil pressure load pushes each swing bush (45*a*, 45*b*) toward the blade (35), thereby expanding the gap between the swing bush (45*a*, 45*b*) and the groove (48). Accordingly, the oil is reliably supplied to the sliding surface of the swing bush (45*a*, 45*b*) along the groove (48), thereby reducing abnormal wear and seizure of the swing bush (45*a*, 45*b*).

In the embodiment, the extending direction of the groove-side oil reservoir (3) of the swing bush (45*a*, 45*b*) intersects the moving direction of the swing bush (45*a*, 45*b*). Thus, as compared to the case where these directions do not intersect, the lubricant in the groove-side oil reservoir (3) is likely to spread on the sliding surface of the swing bush (45*a*, 45*b*) along the groove (48). As a result, the oil is further reliably supplied to the sliding surface of the swing bush (45*a*, 45*b*) along the groove (48).

In the embodiment, since the both ends of the groove-side oil reservoir (3) of the swing bush (45*a*, 45*b*) are vertically open, the lubricant in the groove-side oil reservoir (3) is discharged outside the groove (48). Thus, the lubricant circulates inside the groove-side oil reservoir (3), thereby reducing a rise in the temperature of the lubricant in the groove-side oil reservoir (3) to promote cooling of the sliding surface of the swing bush (45*a*, 45*b*) along the groove (48).

In the embodiment, the blade-side oil reservoir (2) of the swing bush (45*a*, 45*b*) extends in the back and forth direction of the blade (35). Thus, as compared to the case where the blade-side oil reservoir (2) does not extend, the outlet (5) of the oil passage (4) of the blade (35) communicates with the blade-side oil reservoir (2) for the long period. This increases the amount of the lubricant supplied through the outlet (5) of the oil passage (4) to the blade-side oil reservoir (2).

In the embodiment, the curved side surface (6) of the swing bush (45*a*, 45*b*) is cut and flattened to form the groove-side oil reservoir (3) of the swing bush (45*a*, 45*b*). Thus, as compared to the case where, for example, a groove is provided in the curved side surface (6) to form the groove-side oil reservoir (3) of the swing bush (45*a*, 45*b*), the groove-side oil reservoir (3) of the swing bush (45*a*, 45*b*) is readily formed.

First Variation of Embodiment

Figure 6:
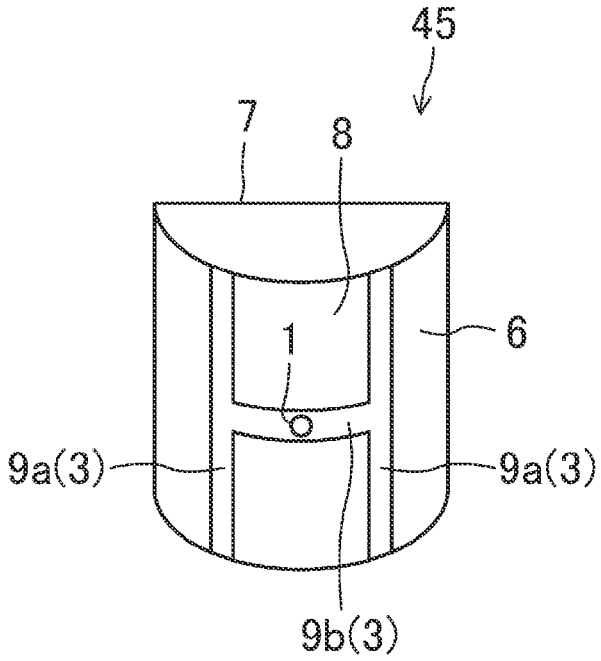
FIG. 6 is a perspective view of a swing hush according to a first variation of the embodiment.

In a first variation of the embodiment shown in FIG. 6, unlike the above-described embodiment, the groove-side oil reservoir (3) of each swing bush (45) includes two vertical grooves (9*a*), and a single lateral groove (9*b*). The vertical grooves (9*a*) extend along the height of the swing bush (45). The both ends of the vertical grooves (9*a*) are open. Each vertical groove (9*a*) is formed on a side of an apex (8) of the curved side surface (6) of the swing bush (45). On the other hand, the lateral groove (9*b*) passes through the center of the apex (8) of the swing bush (45) to communicate with the vertical grooves (9*a*) on the both sides. The oil supply passage (1) of the swing bush (45) is open to the center of the lateral groove (9*b*). The lubricant flowing through the oil supply passage (1) of the swing bush (45) to the lateral groove (9*b*) of the swing bush (45) is supplied through the lateral groove (9*b*) to the plurality of vertical grooves (9*a*).

In the first variation, the groove-side oil reservoir (3) of the swing bush (45) includes the lateral groove (9*b*) and the plurality of vertical grooves (9*a*). Thus, as compared to the case where the groove-side oil reservoir (3) of the swing bush (45) does not include a plurality of grooves, the inner surface (3*a*) of the groove-side oil reservoir (3) of the swing bush (45)

is wide. This increases the oil pressure load acting on the inner surface (3*a*) of the groove-side oil reservoir (3).

In the operation of the two-stage compressor (10), great stress is applied on the apex (8) of the curved side surface (6) of the swing bush (45) due to the pressure of the fluid chambers (51 and 52) formed outside and inside the ring-shaped piston part (41) of the piston (40). Only the lateral groove (9*b*) is formed in the center of the apex (8) of the curved side surface (6). Thus, as compared to the case where the vertical grooves (9*a*) are formed at the apex (8) of the curved side surface (6), the surface of the apex (8) of the curved side surface (6) without grooves readily spreads. Accordingly, even if great stress is applied on the apex (8) of the curved side surface (6), this great stress is received by the surface of the apex (8) of the curved side surface (6) without grooves, thereby hardly damaging the swing bush (45).

Second Variation of Embodiment

Figure 7:
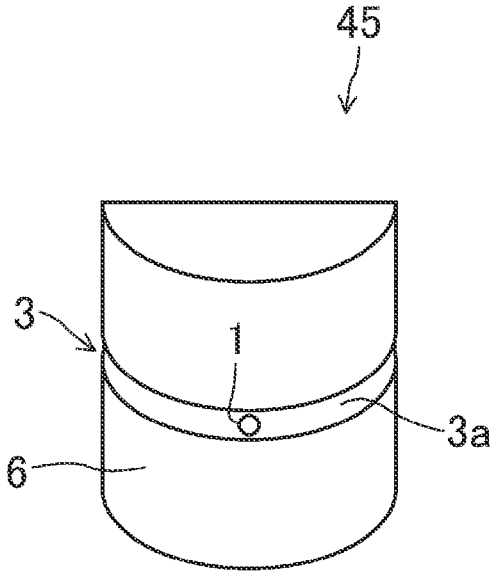
FIG. 7 is a perspective view of a swing bush according to a second variation of the embodiment.

In a second variation of the embodiment shown in FIG. 7, unlike the above-described embodiment, the groove-side oil reservoir (3) of the swing bush (45) is a circumferential groove (3) horizontally extending along the curved side surface (6) of the swing bush (45). That is, the groove-side oil reservoir (3) of the swing bush (45) extends in the sliding direction of the swing bush (45) along the groove (48). The both ends of the circumferential groove (3) communicates with the outside of the groove (48) of the piston (40*a*, 40*b*).

In this second variation, the extending direction of the groove-side oil reservoir (3) of the swing bush (45) coincides with the moving direction of the swing bush (45). Thus, the lubricant in the groove-side oil reservoir (3) is smoothly discharged outside the groove (48). The cooling of the sliding surface of the swing bush (45) along the groove (48) further progresses.

One end of the groove-side oil reservoir (3) of the swing bush (45) communicates with the low pressure chamber (51*a*) of the outer fluid chamber (51) of the cylinder (31*a*, 31*b*). The other end of the groove-side oil reservoir (3) of the swing bush (45) communicates with the low pressure chamber (52*a*) of the inner fluid chamber (52) of the cylinder (31*a*, 31*b*).

In this second variation, the both ends of the groove-side oil reservoir (3) of the swing bush (45) are open to the low pressure chamber (51*a*, 52*a*) of the cylinder (31*a*, 31*b*), which has the lowest pressure inside the two-stage compressor (10). The lubricant in the groove-side oil reservoir (3) of the swing bush (45) further smoothly flows toward the low pressure chamber (51*a*, 52*a*). Therefore, this variation further promotes the cooling of the sliding surface of the swing bush (45) along the groove (48).

Third Variation of Embodiment

Figure 8:
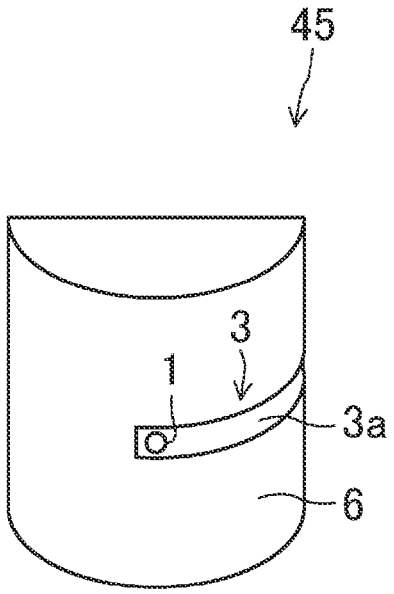
FIG. 8 is a perspective view of a swing bush according to a third variation of the embodiment.

In a third variation of the embodiment shown in FIG. 8, unlike the second variation of the above-described embodiment, the groove-side oil reservoir (3) of the swing bush (45) is a circumferential groove (3) horizontally extends along the curved side surface (6) of the swing bush (45). Only one end of the groove-side oil reservoir (3) is open, and the other end is closed. As such, even where one end of the circumferential groove (3) is open, the lubricant in the groove-side oil reservoir (3) is smoothly discharged outside the groove (48).

Fourth Variation of Embodiment

Figure 9:
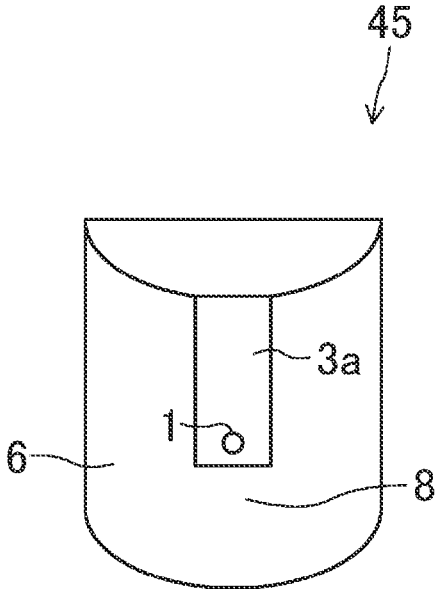
FIG. 9 is a perspective view of a swing bush according to a fourth variation of the embodiment.

In a fourth variation of the embodiment shown in FIG. 9, unlike the above-described embodiment, the apex of the curved side surface (6) of the swing bush (45*a*, 45*b*) is cut from the end surface of the swing bush (45*a*, 45*b*) to the lower side of the oil supply passage (1). Thus, only one end of the groove-side oil reservoir (3) of the swing bush (45) is open, and the other end is closed. As compared to the above-described embodiment, even where the groove-side oil reservoir (3) is short, the cut-out surface (3*a*) of the swing bush (45*a*, 45*b*) is set wider than the inner surface (2*a*) of the blade-side oil reservoir (2), thereby allowing the swing bush (45*a*, 45*b*) toward the blade (35) similarly to the above-described embodiment.

Fifth Variation of Embodiment

Figure 10:
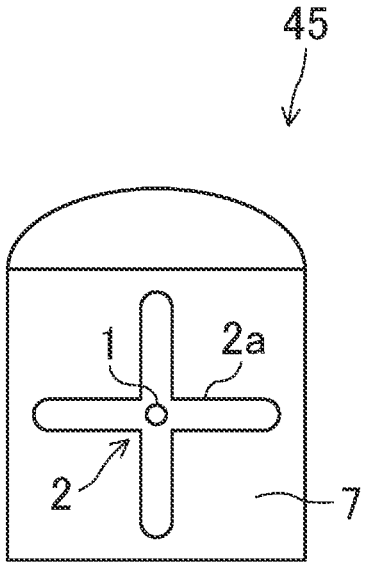
FIG. 10 is a perspective view of a swing bush according to a fifth variation of the embodiment.

In a fifth variation of the embodiment shown in FIG. 10, unlike the above-described embodiment, the blade-side oil reservoir (2) of each swing bush (45*a*, 45*b*) includes two intersecting grooves. The oil supply passage (1) is open to the intersection of the two grooves. Thus, as compared to the above-described embodiment, the lubricant readily spreads vertically and horizontally on the sliding surface of the swing bush (45*a*, 45*b*) along the blade (3).

Sixth Variation of Embodiment

Figure 11:
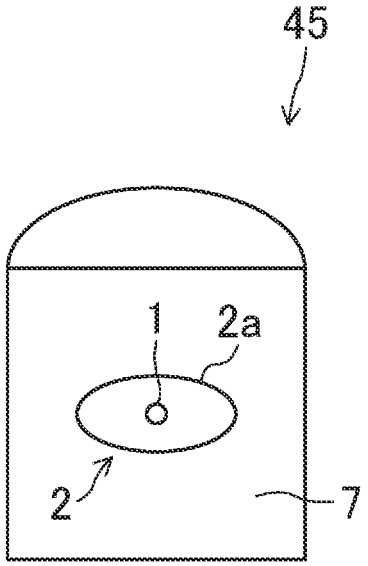
FIG. 11 is a perspective view of a swing bush according to a sixth variation of the embodiment.

In a sixth variation of the embodiment shown in FIG. 11, unlike the above-described embodiment, the blade-side oil reservoir (2) of each swing bush (45*a*, 45*b*) is an oval groove. The oil supply passage (1) is open in the center of the oval groove. In this case, similarly to the fifth variation, the lubricant readily spreads on the sliding surface of the swing bush (45*a*, 45*b*) along the blade (3).

Seventh Variation of Embodiment

Figure 12:
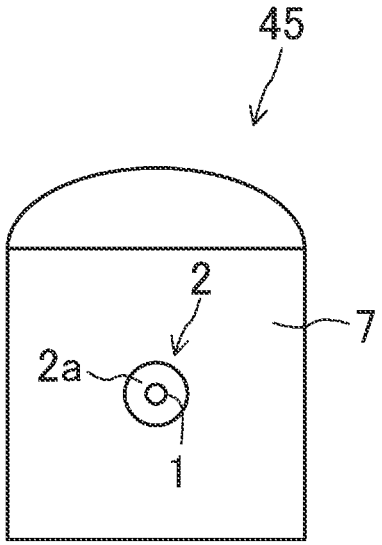
FIG. 12 is a perspective view of a swing bush according to a seventh variation of the embodiment.

In a seventh variation of the embodiment shown in FIG. 12, unlike the above-described embodiment, the blade-side oil reservoir (2) of each swing bush (45*a*, 45*b*) is a circular groove. The oil supply passage (1) is open in the center of the circular groove. In this case, similarly to the fifth variation, the lubricant readily spreads on the sliding surface of the swing bush (45*a*, 45*b*) along the blade (3).

Eighth Variation of Embodiment

Figure 13:
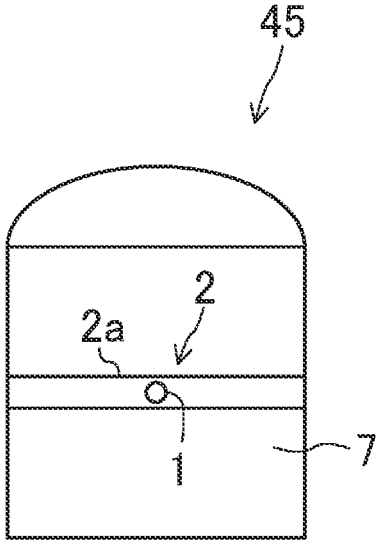
FIG. 13 is a perspective view of a swing bush according to an eighth variation of the embodiment.

In an eighth variation of the embodiment shown in FIG. 13, unlike the above-described embodiment, the both ends of a horizontal groove forming the blade-side oil reservoir (2) of each swing bush (45*a*, 45*b*) communicates with the outside of the groove (48) of each piston (40*a*, 40*b*). The lubricant is smoothly discharged outside the sliding surface of the swing bush (45*a*, 45*b*) along the blade (3). As compared to the case where the both ends of the horizontal groove are closed, the sliding surface is greatly cooled.

Ninth Variation of Embodiment

Figure 14:
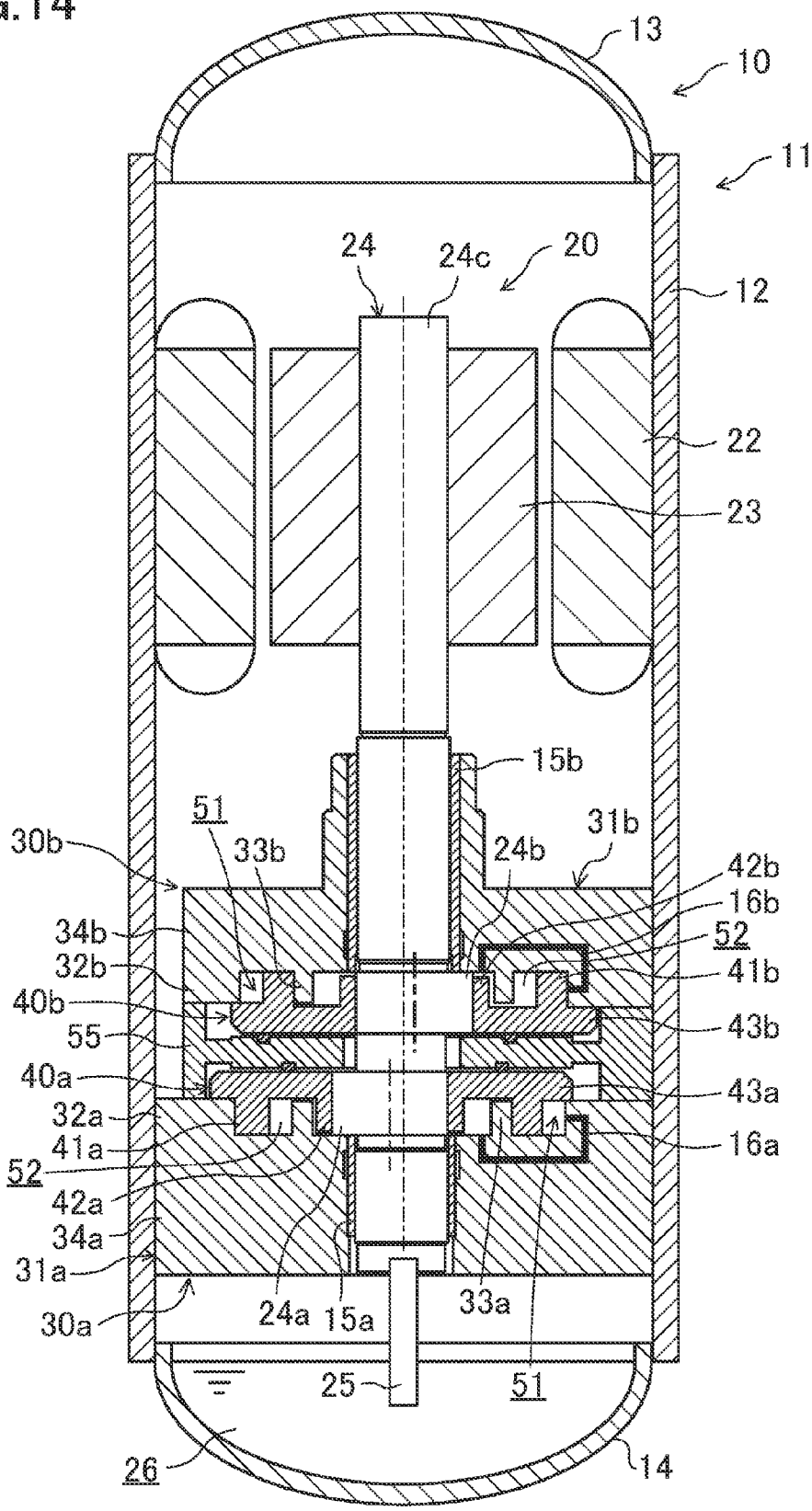
FIG. 14 is a vertical cross-sectional view of a two-stage compressor according to a ninth variation of the embodiment.

In a ninth variation of the embodiment shown in FIG. 14, unlike the above-described embodiment, the supply passage (16*a*, 16*b*) of the compression mechanism (30) extends from an oil reservoir formed between the ring-shaped projection (42*a*, 42*b*) of each piston (40*a*, 40*b*) and the ring-shaped inner cylinder part (33*a*, 33*b*) of each cylinder (31*a*, 31*b*). Accordingly, as compared to the supply passage (16) of the above-described embodiment, the path of the supply passage (16) is shortened. As a result, pressure loss of the lubricant flowing to the supply passage (16) decreases, thereby smoothly supplying the lubricant from the supply passage (16) to the oil passage (36) of the blade (35).

Tenth Variation of Embodiment

Figure 15:
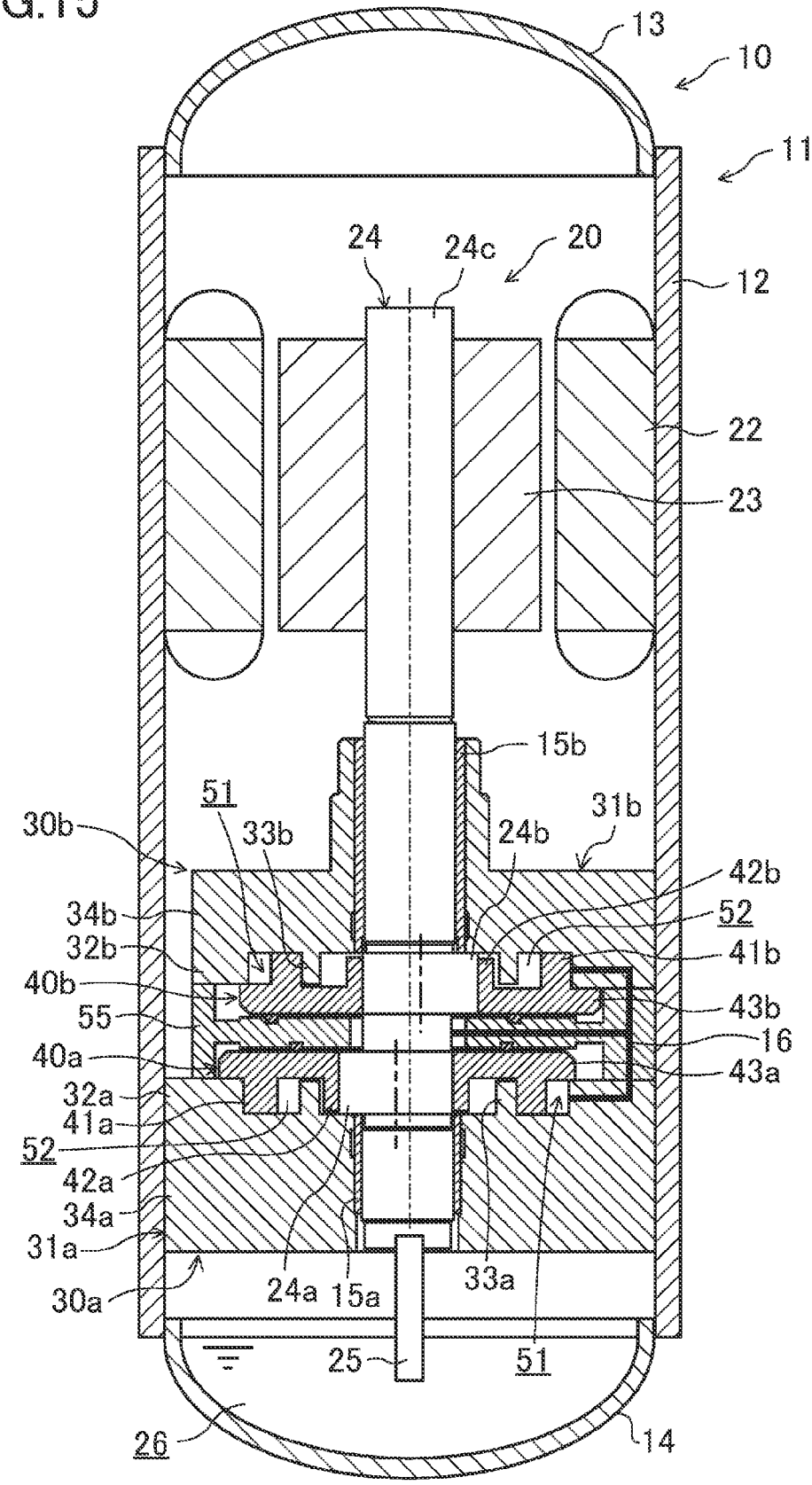
FIG. 15 is a vertical cross-sectional view of a two-stage compressor according to a tenth variation of the embodiment.

In a tenth variation of the embodiment shown in FIG. 15, unlike the above-described embodiment, the supply passage (16) of the compression mechanism (30) extends from an oil reservoir provided between the inner surface of a through hole in the middle plate (55) and the outer surface of the drive shaft (24). The supply passage (16) extending from this oil reservoir to the inside of the middle plate (55) vertically diverges such that one of the paths communicates with the oil passage (36) of the blade (35) at the high stage and the other path communicates with the oil passage (36) of the blade (35) at the low stage. Accordingly, as compared to the supply passage (16) of the above-described embodiment, each path of the supply passage (16) is shortened. As a result, similarly to the ninth variation, pressure loss of the lubricant flowing to the supply passage (16) decreases, thereby smoothly supplying the lubricant from the supply passage (16) to the oil passage (36) of the blade (35).

Eleventh Variation of Embodiment

Figure 16:
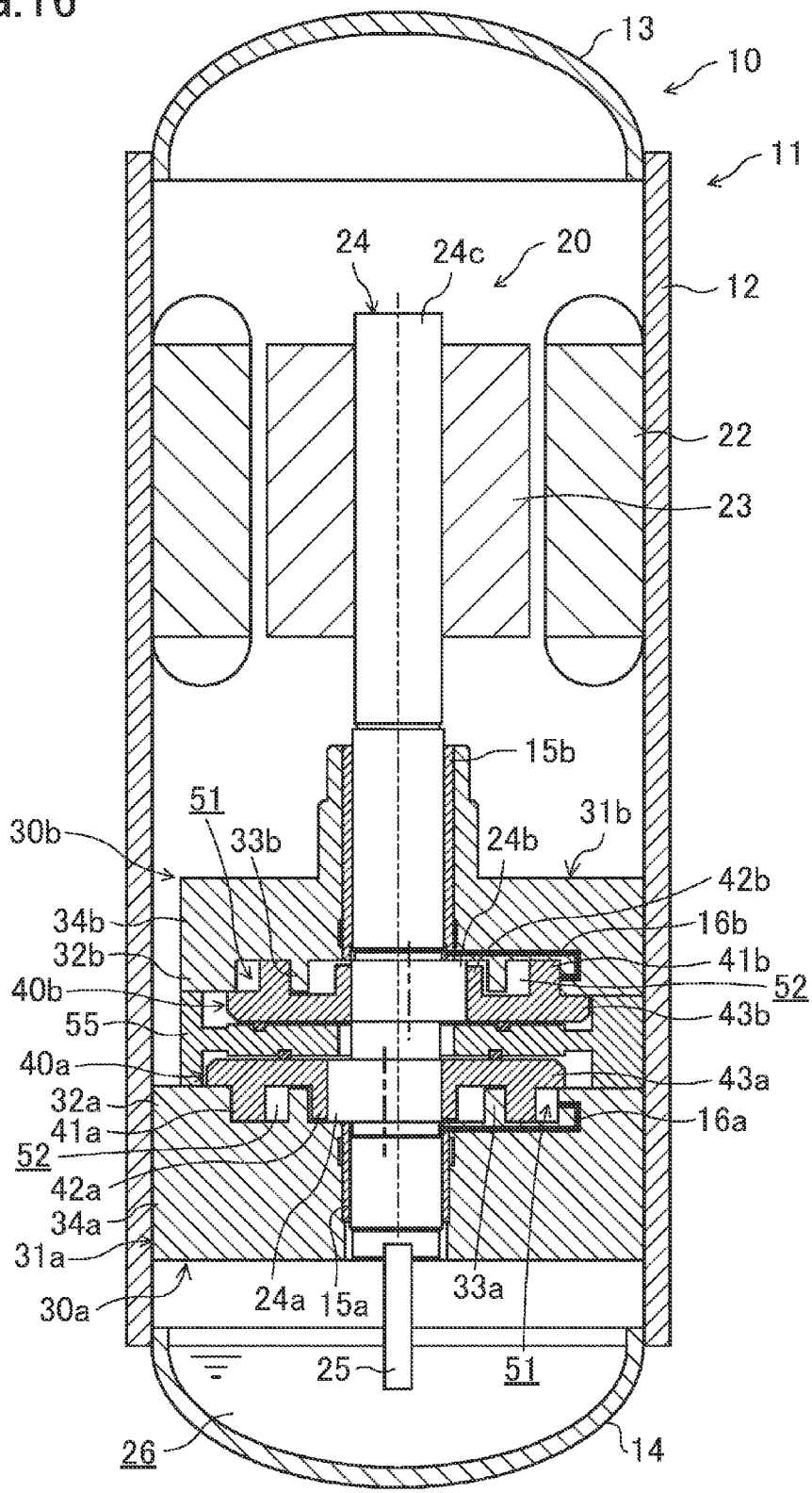
FIG. 16 is a vertical cross-sectional view of a two-stage compressor according to an eleventh variation of the embodiment.

In an eleventh variation of the embodiment shown in FIG. 16, unlike the above-described embodiment, the supply passage (16) of the compression mechanism (30) extends from an oil reservoir provided between the inner surface of a through hole in the cylinder (31*a*, 31*b*) and the outer surface of the drive shaft (24). Accordingly, as compared to the supply passage (16) of the above-described embodiment, the path of each supply passage (16) is shortened. As a result, pressure loss of the lubricant flowing to the supply passage (16) decreases, thereby smoothly supplying the lubricant from the supply passage (16) to the oil passage (36) of the blade (35).

Other Embodiments

The above-described embodiment may have the following configurations.

In the above-described embodiment, the blade (35) is integrally formed with the cylinder (31*a*, 31*b*), and the piston (40*a*, 40*b*) has the groove (48) in which the bush (45*a*, 45*b*) is fitted. The configuration is not limited thereto. The blade (35) may be integrally formed with the piston (40*a*, 40*b*), and the cylinder (31*a*, 31*b*) may have the groove (48) in which the bush (45*a*, 45*b*) is fitted. In this case as well, a result similar to that in this embodiment is obtained.

In the above-described embodiment, each of the high-pressure and low-pressure swing bushes (45*a* and 45*b*) includes the oil supply passage (1), the blade-side oil reservoir (2), and the groove-side oil reservoir (3). The configuration is not limited thereto. Only the low-pressure swing bush (45*a*) may include the oil supply passage (1), the blade-side oil reservoir (2), and the groove-side oil reservoir (3).

In the operation of the two-stage compressor, the pressing force of the blade (35), which is caused by the difference in the pressure between the high pressure chamber (51*b*, 52*b*) and the low pressure chamber (51*a*, 52*a*) of the cylinder chamber (51, 52), acts on the low-pressure side bush (45*a*). That is, the low-pressure side bush (45*a*) is more likely to be pressed to the groove (48) of the piston (40*a*, 40*b*) than the high-pressure side bush (45*b*). Thus, as described above, only the low-pressure swing bush (45*a*) may include the oil supply passage (1), the blade-side oil reservoir (2), and the groove-side oil reservoir (3).

In this case, the oil pressure load of the groove-side oil reservoir (3) acts on the low-pressure side bush (45*a*) so as to counteract the pressing force of the blade (35). Accordingly, as compared to the case where the low-pressure side bush (45*a*) does not include the oil reservoir (2, 3) or the oil supply passage (1), the gap between the low-pressure side bush (45*a*) and the groove (48) of the piston (40*a*, 40*b*) is less likely to narrow. Since the high-pressure side bush (45*b*) does not include the oil reservoir (2, 3) or the oil supply passage (1), the structure of the bush (45*a*, 45*b*) is simplified.

In the above-described embodiment, each of the high-stage and low-stage swing bushes (45) includes the oil supply passage (1), the blade-side oil reservoir (2), and the groove-side oil reservoir (3). The configuration is not limited thereto. One of the high-stage and low-stage swing bushes (45) may include the oil supply passage (1), the blade-side oil reservoir (2), and the groove-side oil reservoir (3). In this case, inflow of unnecessary lubricant into the cylinder chamber (51, 52) decreases and an increase in oil loss of the compression mechanism (30) is mitigated.

The above-described embodiment is a preferable example in nature, and is not intended to limit the scope, applications, and use of the present invention.

INDUSTRIAL APPLICABILITY

As described above, the present invention relates to a rotary compressor, and is particularly useful as a measure to reduce abnormal wear and seizure of a sliding member included in the rotary compressor.

What is claimed is:

1. A rotary compressor comprising:

a cylinder including a cylinder chamber;

a piston configured to eccentrically rotate within the cylinder chamber;

a blade integrally formed with one of the cylinder and the piston and penetrating a groove formed in the other of the cylinder and the piston to segment the cylinder chamber into a high pressure chamber and a low pressure chamber; and a pair of bushes provided at the groove and sandwiching the blade from both sides of the blade to support the blade, at least one of the pair of bushes including an oil supply passage formed from a blade-side sliding surface to a groove-side sliding surface, a blade-side oil reservoir formed on the blade-side sliding surface, one end of the oil supply passage opening to the blade-side oil reservoir, and a groove-side oil reservoir on the groove-side sliding surface, an other end of the oil supply passage opening to the groove-side oil reservoir, and the groove-side oil reservoir being wider than the blade-side oil reservoir.

2. The rotary compressor of claim 1, wherein the groove-side oil reservoir of the bush extends to intersect a sliding direction of the bush along the groove.

3. The rotary compressor of claim 2, wherein one end of the groove-side oil reservoir of the bush communicates with an outside of the groove.

4. The rotary compressor of claim 1, wherein the groove-side oil reservoir of the bush extends in a sliding direction of the bush along the groove, and one end of the groove-side oil reservoir of the bush communicates with an outside of the groove.

5. The rotary compressor of claim 4, wherein one end of the groove-side oil reservoir of the bush communicates with the low pressure chamber of the cylinder chamber.

6. The rotary compressor of claim 1, further comprising:

an oil storage configured to store lubricant; and an oil passage formed inside the blade and allowing the lubricant in the oil storage to circulate in the oil passage, an outlet of the oil passage of the blade being open to a sliding surface of the blade to face the blade-side oil reservoir of the bush, and the blade-side oil reservoir of the bush extending in the sliding direction of the bush along the blade.

7. The rotary compressor of claim 1, wherein the groove-side oil reservoir of the bush is formed by cutting and flattening the groove-side sliding surface of the bush.

8. The rotary compressor of claim 1, wherein each of the bushes has a substantially semicylindrical shape, the groove-side oil reservoir of the bush includes a plurality of vertical grooves formed on both sides of an apex of a curved side surface of the bush and extending along a height of the bush, and a lateral groove passing through part of the apex of the curved side surface of the bush to communicate with the plurality of vertical grooves.

9. The rotary compressor of claim 1, wherein only a low-pressure side bush of the pair of bushes includes the oil supply passage, the blade-side oil reservoir, and the groove-side oil reservoir.

* * * * *